United States Patent [19]

Wincierz et al.

[11] Patent Number: 4,620,886

[45] Date of Patent: Nov. 4, 1986

[54] METHOD OF MAKING ALUMINUM RIVETS WITH HIGH DUCTILITY RETENTION

[75] Inventors: Peter Wincierz, Steinbach; Hans P. Sattler, Bad Homburg, both of Fed. Rep. of Germany

[73] Assignee: Suddeutsche Metallindustrie GmbH & Co. KG, Nuremberg, Fed. Rep. of Germany

[21] Appl. No.: 639,374

[22] Filed: Aug. 9, 1984

[30] Foreign Application Priority Data

Aug. 10, 1983 [DE] Fed. Rep. of Germany ..... 3328890

[51] Int. Cl.[4] ..... C22C 21/00

[52] U.S. Cl. ..... 148/439; 148/11.5 A; 148/127; 420/534; 420/535; 420/536

[58] Field of Search ..... 148/439, 127, 11.5 A; 420/534, 535, 536

[56] References Cited

U.S. PATENT DOCUMENTS 2,301,759 11/1942 Stroup ..... 148/439

*Primary Examiner*—R. Dean

*Attorney, Agent, or Firm*—Karl F. Ross; Herbert Dubno

[57] ABSTRACT

Rivets for use in the aircraft industry are made from a wrought aluminum alloy (Material No. 3.1324 in accordance with DIN). As that alloy will precipitation-harden at room temperature, the rivets must be closed immediately after they have been annealed and quenched. The time in which the rivets can be deformed can be extended to as much as one week if the rivets are stored below −17° C. In order to overcome said disadvantages in the processing of the rivets, 0.002 to 0.3% cadmium is added to the wrought aluminum alloy. The resulting modified material exhibits a delayed precipitation hardening at room temperature and even when it is fully precipitation-hardened has a very high ductility. For this reason the precipitation hardening will not impose restrictions as regards the time in which rivets made of said alloy can be closed.

11 Claims, 1 Drawing Figure

METHOD OF MAKING ALUMINUM RIVETS WITH HIGH DUCTILITY RETENTION

FIELD OF THE INVENTION

Our present invention relates to aluminum rivets and, more particularly, to a method of making aluminum rivets with high ductility retention, i.e. with the physical property of retaining a high ductility for a prolonged period of time.

BACKGROUND OF THE INVENTION

It is known to fabricate rivets from a wrought aluminum alloy containing 0.20 to 0.80% Si, 0 to 0.70% Fe, 3.5 to 4.5% Cu, 0.40 to 1.0% Mn, 0.40 to 1.0% Mg, 0 to 0.10% Cr, 0 to 0.25% Zn, 0 to 0.20% Ti +Zr, other elements in an amount of 0 to 0.05% each and in a total of 0 to 0.15%, balance aluminum (percents by weight).

This alloy has the Material No. 3.1324 in accordance with DIN Standards (German Federal Republic Standards) and the Number 2017 of the Aluminum association. It is mainly used to make rivets in the aircraft industry in accordance with LN 9197, 9198 and 9199. As supplied, the alloy has an ultimate tensile strength of 215 to 295 $N/mm^2$ and transversely to the longitudinal axis has a shear strength of 255 $N/mm^2$.

In accordance with page 4 of Annex 1 of Werkstoff-Legierungsblatt WL 3.1324, Issue June 1983, rivets made of this alloy must be solution-heated and quenched immediately before they are deformed. The rivets must be in a so-called unstable state while they are closed and the closing must be completed within two hours after the quenching. If the rivets cannot be closed within two hours after their quenching, they must be stored in freezers at −17° C. But even in that case the rivets must be closed within one week. Rivets which have been precipitation-hardened at room temperature or have been stored for an excessively long time can be heat-treated again about five times.

No time limits need to be observed when rivets are closed which have been precipitation hardened at room temperature But in that case a formation of cracks in the closing head and a reduced fatigue limit of the riveted joint must be expected.

The use of the rivets is rendered very difficult by the regulations which permit a closing of the rivets only when they have been soft-annealed and subsequently quenched. In the manufacture of new aircraft and other new riveted articles, the processing requirements can be met by the use of suitable equipment and a suitable organization. But even in that case, errors and confusion cannot be precluded. The regulations for the closing of the rivets are particularly undesirable in repair work, which may be required on any airport, where the equipment and personnel required for a closing of the rivets in accordance with the regulations may not always be available.

For this reason there have been numerous attempts to replace the above-mentioned alloy by a material which retains a high ductility for a prolonged time so that the rivets can be closed without disadvantages at any time after they have been annealed and quenched.

The restrictive conditions need not be met if Alloy WL 3.1324 is deformed after it has been precipitation-hardened at room temperature. But in that case a formation of cracks will be more likely and the riveted joint will have a lower fatigue limit than when the rivets are deformed in the recommended state (see page 4 of Annex to WL 3.1324).

In accordance with another proposal, alloy AlZnMg AA 7050 is recommended as a material for rivets which retain a high ductility for a long time. Said rivets are precipitation-hardened at elevated temperatures in two stages and the temperatures at which they are precipitation-hardened must be very carefully controlled if the intended strength properties are to be achieved. Besides, said material is liable to form stress cracks and is rather expensive.

It is also desired to use a known alloy that has already been used for this purpose in the production of rivets which retain a high ductility for a long time because a new alloy could not be used unless it meets the requirements also in all other respects and this would require extensive technical tests and prolonged licensing procedures.

OBJECTS OF THE INVENTION

It is the principal object of the present invention to provide an improved method of making rivets, especially for aeronautical applications, which comply with present standards and norms, but which have improved ductility retention.

Another object is to provide improved rivets which are free from some of the drawbacks of prior art rivets.

Still another object of the invention is to provide an improved method of fabricating aluminum rivets so that disadvantages of earlier systems can be avoided.

SUMMARY OF THE INVENTION

We have surprisingly discovered that it is possible to modify the material WL 3.1324 so that rivets made from the new material will retain a high ductility for a long time so that their closing is not restricted to a short time after they have been annealed and quenched and that the complicated cold storage, in which errors are liable to occur, can be avoided.

This is accomplished in that 0.002 to 0.30% cadmium is added to the alloy. Cadmium is preferably added in an amount of 0.002 to 0.05%. Whereas the same results will be produced by an addition in the range from 0.05 to 0.3%, in the latter case the cadmium content exceeds the upper limit of 0.05% specified in WL 3.1324 for other elements and a new alloy will be obtained, for which new testing and licensing procedures will be required in dependence on the desired field of application.

In previous attempts to provide rivets which retain a high ductility for a long time it has mainly been endeavored to influence the precipitation-hardening behavior of material 3.1324 so that the time in which the rivets can be closed will be prolonged whereas the precipitation-hardening of the deformed rivet was not definitely suppressed. It has been known for a long time that the precipitation-hardening of AlCu and AlCu4.5 LiMn alloys can be delayed by small additions of cadmium, indium or tin (Hardy, H. K. Inst. Metals 80 (1951/52), pages 483/492; Anderko/Wiencierz in Z. Aluminium, 37th Year (1961), No. 9, pages 493/460, and No. 10, pages 663/677).

It has not been possible before to use these discoveries in the provision of a rivet which retains a high ductility for a long time becuase it has been found that additions of indium and tin, just as additions of cadmium, may delay or even suppress precipitation-hardening. But the fact that a lower hardness is maintained for a prolonged time is not beneficial for maintaining the rivets in a readily deformable condition for a long time. The latter property of the rivets depends on the ductility of the material rather than on its hardness. The ductility achieved by an addition of indium and tin was not sufficient for the making of satisfactory riveted joints.

However, we now have found that an addition of cadmium will not only delay precipitation-hardening but the resulting alloy will have a high ductility for a long time after it has been annealed and quenched. This can be proved for rivet materials by an upsetting test.

SPECIFIC DESCRIPTION

Figure 1:
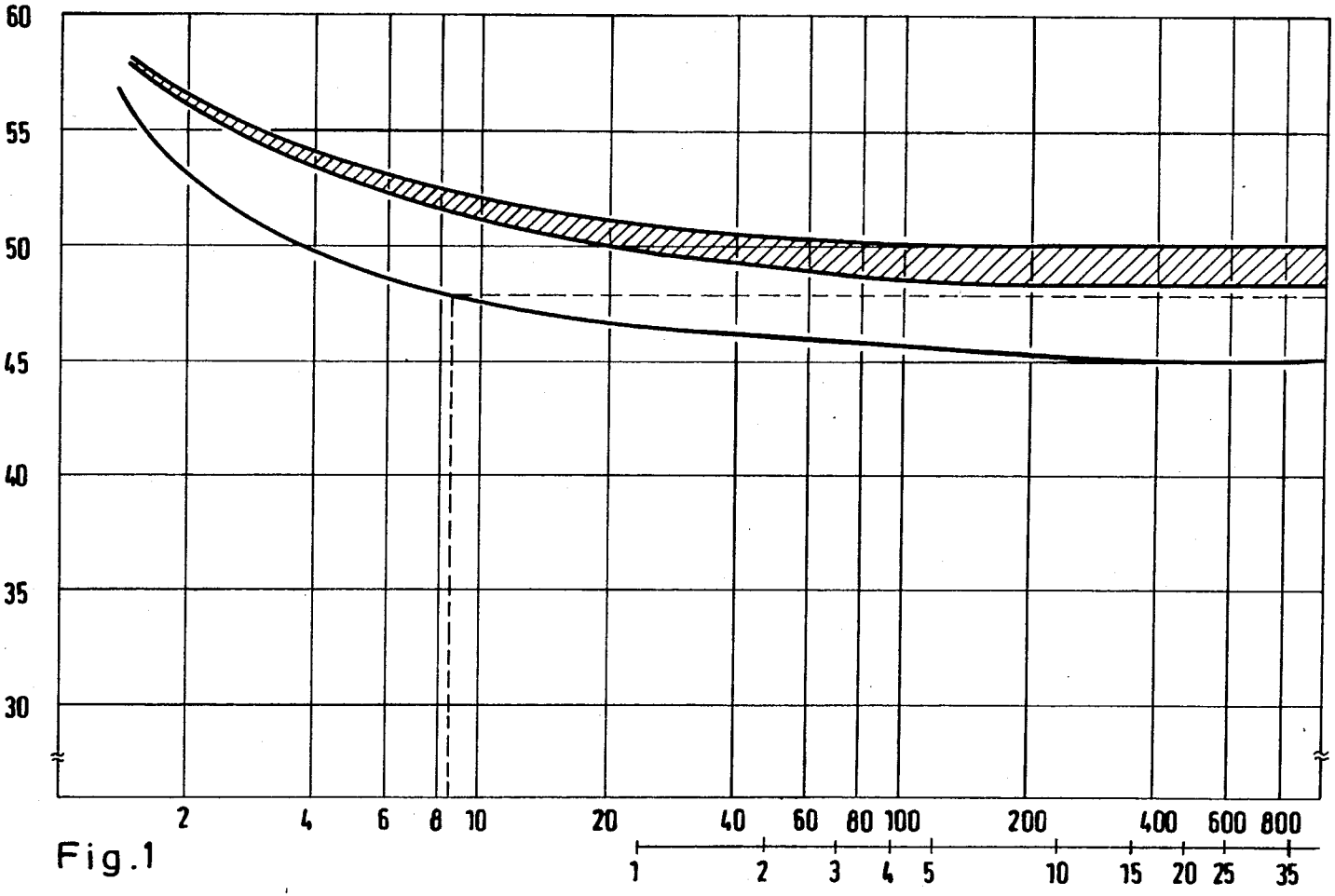
FIG. 1 is a graph in which degree of upset is plotted against the precipitation-hardening time.

Specimens which were 4.7 mm in diameter and had a length of 5.65 mm are annealed and quenched and were upset by a constant stress of 1150 $N/mm^2$ at certain times after the annealing and quenching. The extent to which the specimens had been upset was plotted against the precipitation-hardening time (FIG. 1). Under these conditions, the cadmium-free alloy in accordance with WL 3.1324 has an initial upsettability of about 57% and its upsettability decreases to about 48% in 8.5 hours and to 45% in 35 days. The alloy in accordance with the invention, to which 0.002 to 0.05% cadmium has been added, has an initial upsettability of 58% and its upsettability amounts to 52 to 52.5% after 8.5 hours and to 48 to 50% after 35 days.

It is significant that the upsettability of the cadmium-containing specimens is higher after any desired time than that of the cadmium-free specimens after 8.5 hours.

In accordance with a report TE 245/480/82 dated Aug. 10, 1982, issued by "Vereinigte flugtechnische Werke GmbH", the time in which rivets made of the material 3.1324 can be closed can be increased from 2 to 8.5 hours and the life determined by the Wöhler test will not be decreased thereby.

In other words, the decrease of the upsettability of the previously used rivet material within 8.5 hours does not adversely affect the fatigue limit of the riveted joint and in the cadmium-containing material in accordance with the invention the upsettability is so high even after any desired time that a decrease of the fatigue limit need not be feared.

This shows that the object set forth to provide a rivet material which remains ductile for a long time has been accomplished and with an alloy 3.1324 containing up to 0.05% cadmium this is achieved without a need for a new licensing procedure because other additions up to 0.05% are explicitly permitted by the regulations.

We claim:

1. A method of making rivets which retain a high ductility for a prolonged time which comprises forming a wrought aluminum alloy consisting essentially of by weight 0.20 to 0.80% Si, 0 to 0.70% Fe, 3.5 to 4.5% Cu, 0.40 to 1.0% Mn, 0.40 to 1.0% Mg. 0 to 0.10% Cr, 0 to 0.25% Zn, 0 to 0.20% Ti +Zr, other elements in an amount of 0 to 0.05% each and in a total of 0 to 0.15%, balance aluminum and increasing the ductility retentivity thereof by adding 0.002 to 0.30% cadmium to the alloy, and thereafter fabricating rivets from the wrought alloy.

2. The method defined in claim 1 wherein 0.002 to 0.05% cadmium are added to the alloy.

3. The method defined in claim 1 wherein 0.05 to 0.3% cadmium are added to the alloy.

4. A wrought aluminum alloy for making rivets which retain a high ductility for a prolonged time, which alloy consists essentially of 0.20 to 0.80% Si, 0 to 0.70% Fe, 3.5 to 4.5% Cu, 0.40 to 1.0% Mn, 0.40 to 1.0% Mg, 0 to 0.10% Cr, 0 to 0.25% Zn, 0 to 0.20% Ti +Zr, other elements in an amount of 0 to 0.05% each and in a total of 0 to 0.15%, balance aluminum, and which contains 0.002 to 0.3% cadmium.

5. The wrought aluminum alloy defined in claim 4 wherein the alloy contains 0.002 to 0.05% cadmium.

6. The wrought aluminum alloy defined in claim 4 wherein the alloy contains 0.05 to 0.3% cadmium.

7. A rivet which retains a high ductility for a prolonged time and made of a wrought aluminum alloy which consists essentially of 0.20 to 0.80% Si, 0 to 0.70% Fe, 3.5 to 4.5% Cu, 0.40 to 1.0% Mn, 0.40 to 1.0% Mg, 0 to 0.10% Cr, 0 to 0.25% Zn, 0to 0.20% Ti +Zr, 0.002 to 0.3% cadmium, other elements in an amount of 0 to 0.05% each and in a total of 0 to 0.15%. balance aluminum.

8. The rivet defined in claim 7 wherein the alloy contains 0.002 to 0.05% cadmium.

9. The rivet defined in claim 7 wherein the alloy contains 0.05 to 0.3% cadmium.

10. The rivet defined in claim 7 in an annealed and subsequently quenched state.

11. A process of making riveted joints by means of rivets made from a wrought aluminum alloy consisting essentially of 0.20 to 0.80% Si. 0 to 0.70% Fe, 3.5 to 4.5% Cu, 0.40 to 1.0% Mn, 0.40 to 1.0% Mg, 0 to 0.10% Cr, 0 to 0.25% Zn, 0 to 0.20% Ti +Zr, other elements in an amount of 0 to 0.05% each and in a total of 0 to 0.15%, balance aluminum, and 0.002 to 0.3% Cd, wherein said rivets are annealed and subsequently quenched and are closed to form the joint when they have been stored for more than 8.5 hours at room temperature after they have been quenched.

* * * * *